US011819873B2

(12) United States Patent
Sollinger et al.

(10) Patent No.: US 11,819,873 B2
(45) Date of Patent: Nov. 21, 2023

(54) MACHINE FOR APPLYING SEALING MATERIAL TO A METAL ELEMENT, IN PARTICULAR INTENDED FOR A METAL PACKAGE

(71) Applicant: GEM SRL, Saronno (IT)

(72) Inventors: Marco Sollinger, Saronno (IT); Mirko Battistini, Uboldo (IT); Paolo Bozza, Venice (IT); Matteo Gatto, Alessandria (IT)

(73) Assignee: GEM S.R.L., Saronno (IT)

( * ) Notice: Subject to any disclaimer, the term of this patent is extended or adjusted under 35 U.S.C. 154(b) by 77 days.

(21) Appl. No.: 17/278,193

(22) PCT Filed: Sep. 19, 2019

(86) PCT No.: PCT/IT2019/050203

§ 371 (c)(1),
(2) Date: Mar. 19, 2021

(87) PCT Pub. No.: WO2020/059000

PCT Pub. Date: Mar. 26, 2020

(65) Prior Publication Data

US 2021/0370344 A1 Dec. 2, 2021

(30) Foreign Application Priority Data

Sep. 19, 2018 (IT) ..... 102018000008733

(51) Int. Cl.
*B05C 13/02* (2006.01)
*B05C 5/02* (2006.01)

(52) U.S. Cl.
CPC ..... *B05C 13/025* (2013.01); *B05C 5/022* (2013.01)

(58) Field of Classification Search
None
See application file for complete search history.

(56) References Cited

U.S. PATENT DOCUMENTS 4,117,798 A * 10/1978 Cornelius ..... B05C 9/045 118/506
6,391,387 B1 * 5/2002 Rutledge ..... B05C 5/0216 427/256

(Continued)

FOREIGN PATENT DOCUMENTS

| | | |
|---|---|---|
| EP | 1 410 859 A1 | 4/2004 |
| GB | 1 593 457 A | 7/1981 |
| WO | 98/30339 A1 | 7/1998 |

OTHER PUBLICATIONS

International Search Report and Written Opinion from PCT/IT2019/050203 dated Dec. 16, 2019 (9 pages).

*Primary Examiner* — Jethro M. Pence
(74) *Attorney, Agent, or Firm* — CALFEE HALTER & GRISWOLD LLP

(57) ABSTRACT

Machine for applying sealing material to a metal element comprises at least one electromagnetic mandrel provided with a main body to house at least one electromagnet and a support to hold the metal element in position on a work surface following the excitation of the electromagnet; the main body is connected to drive means configured to make the support rotate on the work surface; the delivery device of the sealing material is positioned at least in proximity to the periphery of the metal element and is able to deliver sealing material when the metal element is held in position and made to rotate on the work surface by means of the support of the electromagnetic mandrel.

20 Claims, 5 Drawing Sheets

(56) References Cited

U.S. PATENT DOCUMENTS

| | | | | |
|---|---|---|---|---|
| 6,547,878 | B2 * | 4/2003 | Rutledge | B05C 5/0216 427/256 |
| 10,625,298 | B2 * | 4/2020 | Koda | B05C 13/025 |
| 2002/0048633 | A1 | 4/2002 | Rutledge | |

* cited by examiner

MACHINE FOR APPLYING SEALING MATERIAL TO A METAL ELEMENT, IN PARTICULAR INTENDED FOR A METAL PACKAGE

CROSS-REFERENCE TO RELATED APPLICATIONS

This application is a 371 of PCT Application No. PCT/IT2019/050203 filed on Sep. 19, 2019, which claims priority to Italian Application No. 102018000008733 filed on Sep. 19, 2018, the contents of which are hereby incorporated by reference as if recited in their entirety.

FIELD OF THE INVENTION

The present invention concerns a machine for applying sealing material to a metal element, in particular intended for a metal package.

The sealing material that is applied on the metal element can be mastic, glue or other similar material, initially in the liquid state and which solidifies after the application on the metal element.

BACKGROUND OF THE INVENTION

It is known that metal packages generally comprise one or more metal elements to be assembled to a container, for example metal disks that constitute the bottom and/or the lid of the metal package, for example metal tins for foodstuffs, for example of cylindrical shape, or the bottoms of cans, canisters or other.

At least one layer of sealing material, for example mastic, glue or suchlike, is applied to these metal elements, in particular in proximity to the periphery or external edge thereof; the mastic, glue or suchlike is initially in liquid form, then solidifies after a short time after the application. The sealing material therefore assumes the appearance of a creasing, or suchlike, applied in proximity to the external edge of the metal element.

For the application of this sealing material, machines are known that provide conveyor belts of the essentially electromechanical type, which feed the metal elements toward a station for applying the sealing material, where a device for delivering the sealing material in liquid form, for example an injector or suchlike, is provided.

Generally, these metal elements are carried by the conveyor belt toward a mandrel equipped with a support on which the metal element is positioned, and which is raised toward the sealing material delivery device.

The mandrel has substantially the dual function of raising the metal element toward the sealing material delivery device and of making the metal element rotate with respect to the sealing material delivery device. In some types of mandrel, moreover, a tailstock, or counter-mandrel, is also provided, in order to maintain the metal element correctly in position, once it is raised with respect to the conveyor belt.

The traditional mandrels to support, raise and rotate the metal element to which the sealing material will be applied often prove to have an excessively articulated and not very efficient functioning, since there is the need to raise the metal element, moreover it is rather common to see unwanted phenomena of slippage of the metal element, and again the tailstock can cut and damage the metal element itself, which is in contact with the latter and made to rotate.

The mandrels of traditional machines for applying sealing material, in general, often prove to be rather complex, not very precise and not very efficient. Moreover, they can cause unwanted damage to the metal element supported.

Another problem of traditional machines for applying sealing material is that they require a series of mechanical or electromechanical means for transferring the metal elements between the various sections or parts of the machine, for example stackers of metal elements, removal devices or other means located upstream of the device for applying the sealing material, and also mechanical or electromechanical means for transferring the mechanical elements toward the exit of the machine, once the sealing material has been applied on these mechanical elements.

The metal elements generally come from a press, a curling machine or other supply apparatus and are transferred to the traditional machines for applying the sealing material with the aid, specifically, of discs stackers, removal devices or other mechanical or electromechanical transfer means.

Naturally, the use of such mechanical or electromechanical means for transferring the metal elements makes the traditional machines excessively complex, not very efficient, moreover they involve a large number of metal elements to be discarded and require different interruptions in the event of faults or malfunctions.

Other limitations and disadvantages of conventional solutions and technologies will be clear to a person of skill after reading the remaining part of the present description with reference to the drawings and the description of the embodiments that follow, although it is clear that the description of the state of the art connected to the present description must not be considered an admission that what is described here is already known from the state of the prior art.

There is therefore the need to perfect a machine for applying sealing material to a metal element, in particular intended for a metal package, which can overcome at least one of the disadvantages of the state of the art.

One purpose of the present invention is to provide a machine for applying sealing material on a metal element, in particular intended for a metal package, substantially of the electromagnetic type, which limits the use of mechanical means for transferring or displacing the metal elements as much as possible, both upstream and also downstream of the sealing material application zone, therefore having a decidedly improved production speed and efficiency compared to traditional machines.

Another purpose of the present invention is to provide a machine for applying sealing material on a metal element, in particular intended for a metal package, which substantially does not require the metal element to be raised in the sealing material application zone, substantially by using an effective electromagnetic mandrel to support the metal element on which the sealing material is applied, in particular an electromagnetic mandrel which substantially eliminates slippage phenomena of the metal elements supported, which maintains their integrity intact and which allows their precise and effective support.

Another purpose of the present invention is to provide a machine for applying sealing material on a metal element, in particular intended for a metal package, which advantageously reduces interruptions or down times for intervention operations caused by various jammings or failures, since mechanical means for transferring the metal elements from one zone to the other of the machine are substantially eliminated or limited as much as possible.

The Applicant has devised, tested and embodied the present invention to overcome the shortcomings of the state of the art and to obtain these and other purposes and advantages.

SUMMARY OF THE INVENTION

The present invention is set forth and characterized in the independent claim. The dependent claims describe other characteristics of the invention or variants to the main inventive idea.

In accordance with the above purposes, one purpose of the invention is a machine for applying a sealing material to a metal element, in particular intended for a metal package, comprising at least one transfer track of the metal element from an entrance zone to the machine to at least one sealing material application zone in which at least one delivery device to deliver the sealing material onto the metal element is positioned.

According to one aspect of the invention, this machine comprises at least one electromagnetic mandrel provided with a main body to house at least one electromagnet and a support to hold the metal element in position on a work surface following the excitation of the electromagnet; the main body is connected to drive means configured to make the support rotate on the work surface; the sealing material delivery device is positioned at least in proximity to the periphery of the metal element and able to deliver sealing material when the metal element is held in position and made to rotate on the work surface by means of the support of the electromagnetic mandrel.

The work surface on which the metal element lies, during the application of the sealing material, preferably is substantially coplanar to a plane on which the at least one transfer track lies.

The at least one transfer track can be located, during use and advantageously, directly downstream of a supply apparatus to supply the metal element to which the sealing material is applied.

The machine can comprise at least one arm provided with one or more electromagnets able to remove the metal element from the transfer track, to position it in correspondence with the electromagnetic mandrel in order to apply the sealing material by means of the delivery device and then to transfer it from the electromagnetic mandrel to at least one exit track of the metal element on which the sealing material has been applied.

The transfer track can be directed in a first direction different from a second direction along which the second exit track is directed, and the arm can be located in a direction which intersects the transfer track and the exit track.

The machine can comprise at least one battery of arms associated with at least one transfer track and at least one exit track; the arms of the battery can be reciprocally parallel and directed in directions which intersect the at least one transfer track and the at least one exit track The sealing material delivery device can be connected to a rotatable shaft provided with suitable drive means, so that the delivery device can assume at least a first active position in which it is positioned substantially and at least partly above the metal element, and a second inactive position in which it is positioned above a bleeder receptacle.

The support of the metal element can be interchangeable and connected to the main body of the electromagnetic mandrel by removable attachment elements.

The support can comprise at least one seating configured to house at least one protruding part of the metal element.

Preferably, the transfer track and/or the exit track comprises or consists of magnetic or electromagnetic conveyor belts.

These and other aspects, characteristics and advantages of the present disclosure will be better understood with reference to the following description, drawings and attached claims. The drawings, which are integrated and form part of the present description, show some embodiments of the present invention, and together with the description, are intended to describe the principles of the disclosure.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

ILLUSTRATION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DESCRIPTION OF EMBODIMENTS

We will now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

Figure 1:
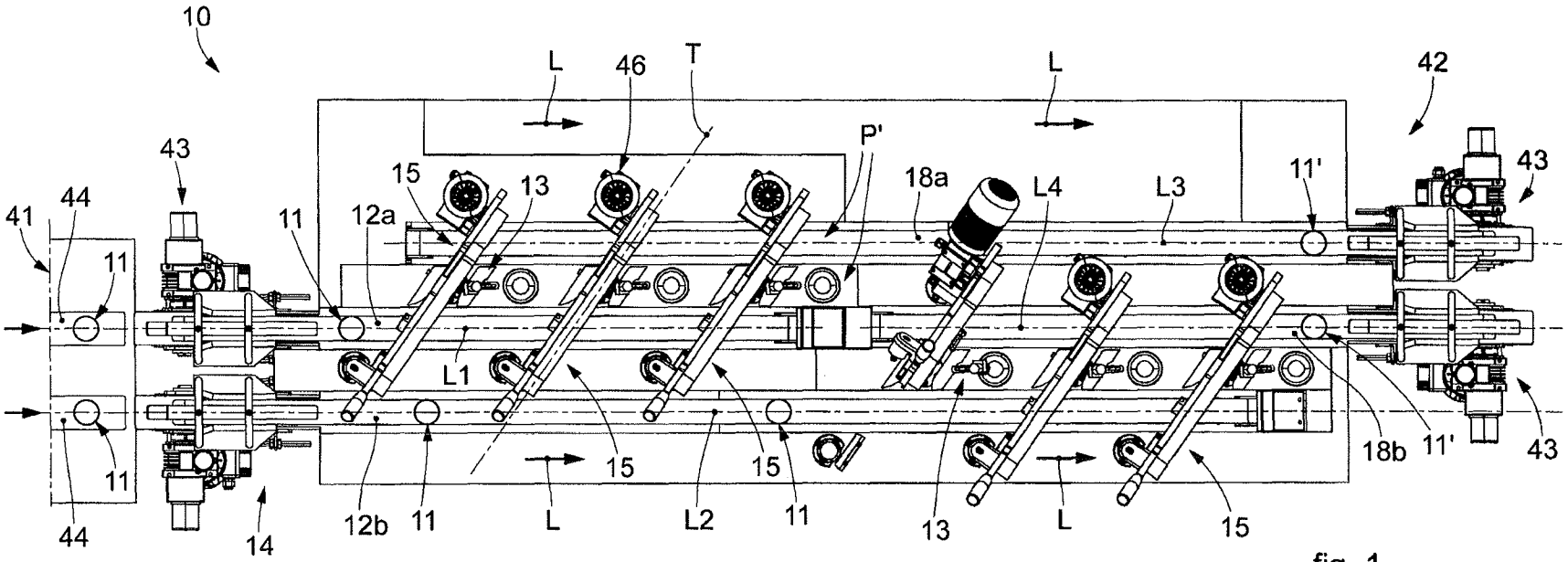
FIG. 1 is a plan view of a machine, according to the present invention, for applying sealing material to a metal element, in particular intended for a metal package.

With reference to the attached drawings, see for example FIG. 1 thereof, a machine 10 for applying sealing material to a metal element 11, in particular intended for a metal package, comprises at least one transfer track 12*a*, 12*b* of the metal element 11 from an entrance zone 14 to the machine 10 to least one sealing material application zone, in which at least one delivery device 13 to deliver the sealing material onto the metal element 11 is positioned.

As mentioned, the metal element 11 can be a metal element that can be part of a metal package, so for example the bottom of a metal tin, a canister, a can or other. The metal element 11 can be for example a disk or suchlike, substantially smooth or variously shaped.

The machine 10 can preferably comprise at least two transfer tracks 12*a* and 12*b* of the metal elements 11 to which the sealing material is applied, as shown.

Figure 4:
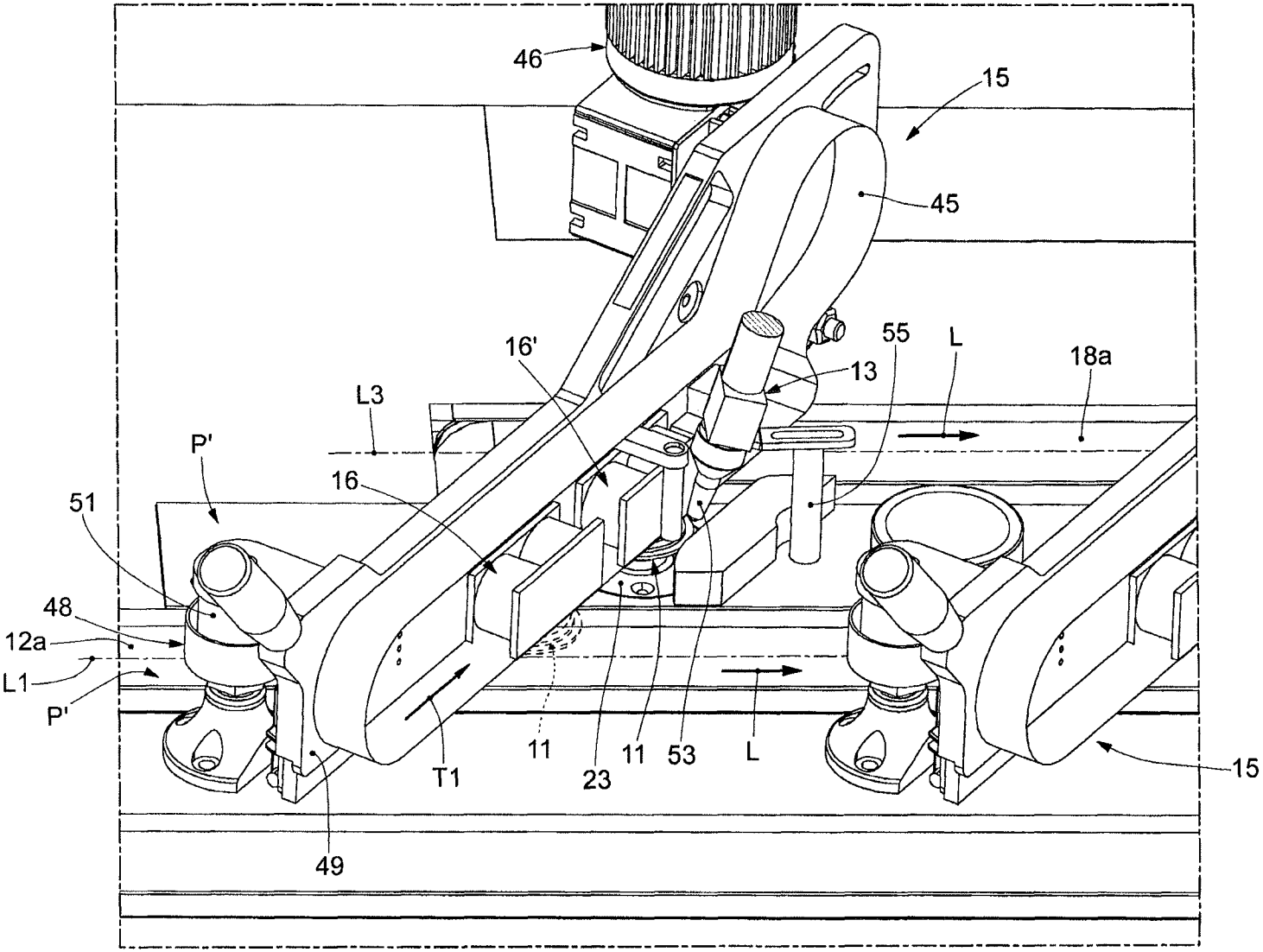
FIG. 4 is a three-dimensional view of a zone of the machine where the application of the sealing material to a metal element is performed, taken into this zone by a transfer arm.
Figure 5:
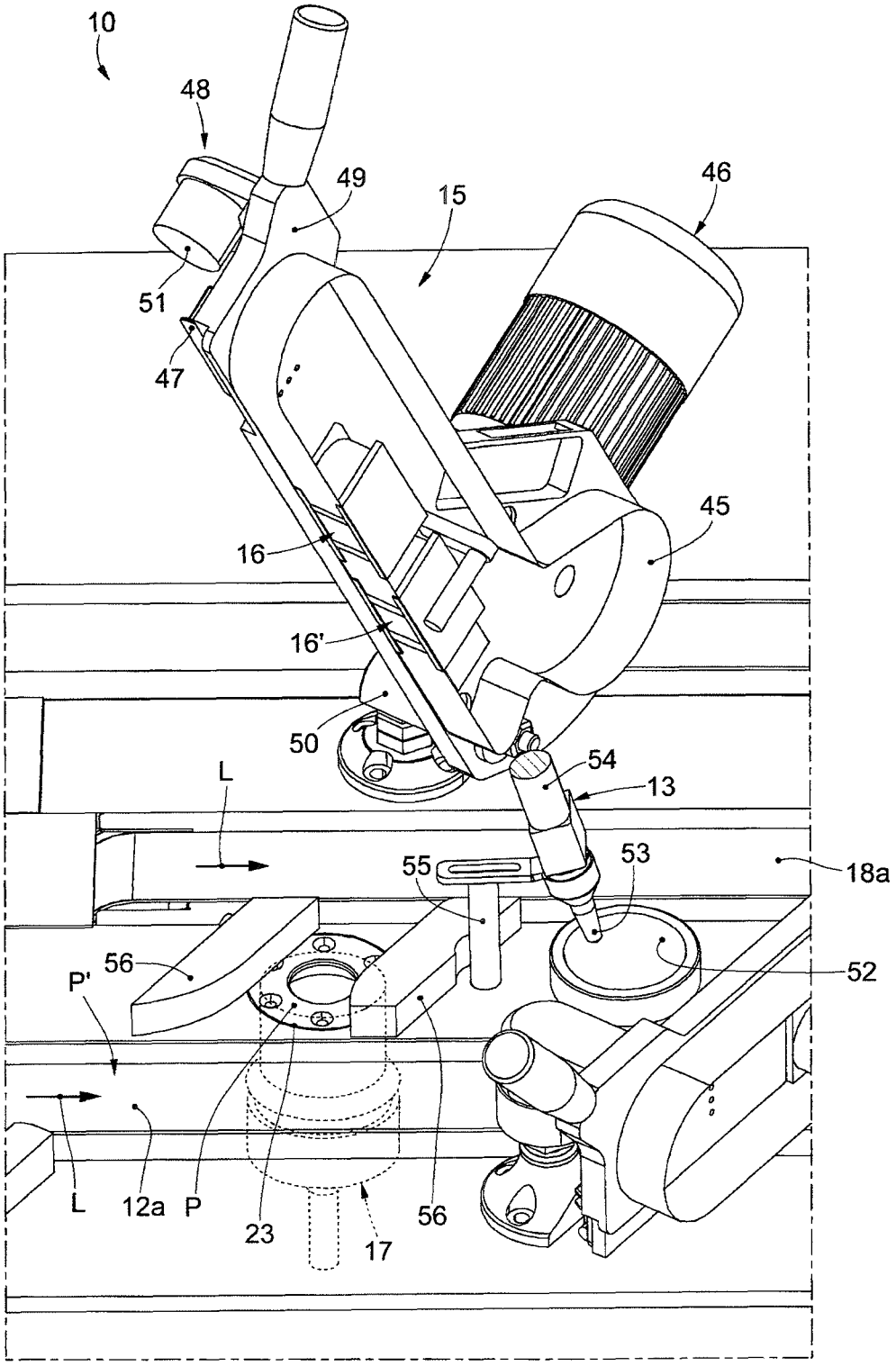
FIG. 5 is a three-dimensional view of a non-operative situation of the transfer arm of FIG. 4.

At least one arm 15 is associated with each of the transfer tracks 12*a* or 12*b* which is provided with one or more electromagnets 16, 16', see for example FIG. 4 or FIG. 5, which are able to remove said metal element 11 from said transfer track 12*a* and transfer it to an electromagnetic mandrel 17, then remove it again from the electromagnetic mandrel 17 and then transfer it to at least one exit track 18*a*, 18*b*.

Figure 2:
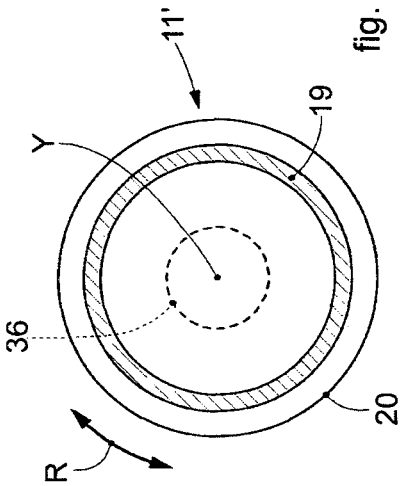
FIG. 2 is a schematic plan view of a metal element with the sealing material applied.

FIG. 2 schematically shows a metal element 11' to which a creasing 19 of sealing material has been applied and which will be transferred onto the exit track 18*a*, 18*b*.

The creasing 19 is applied for example in proximity to the periphery 20 of the metal element 11'.

Figure 6:
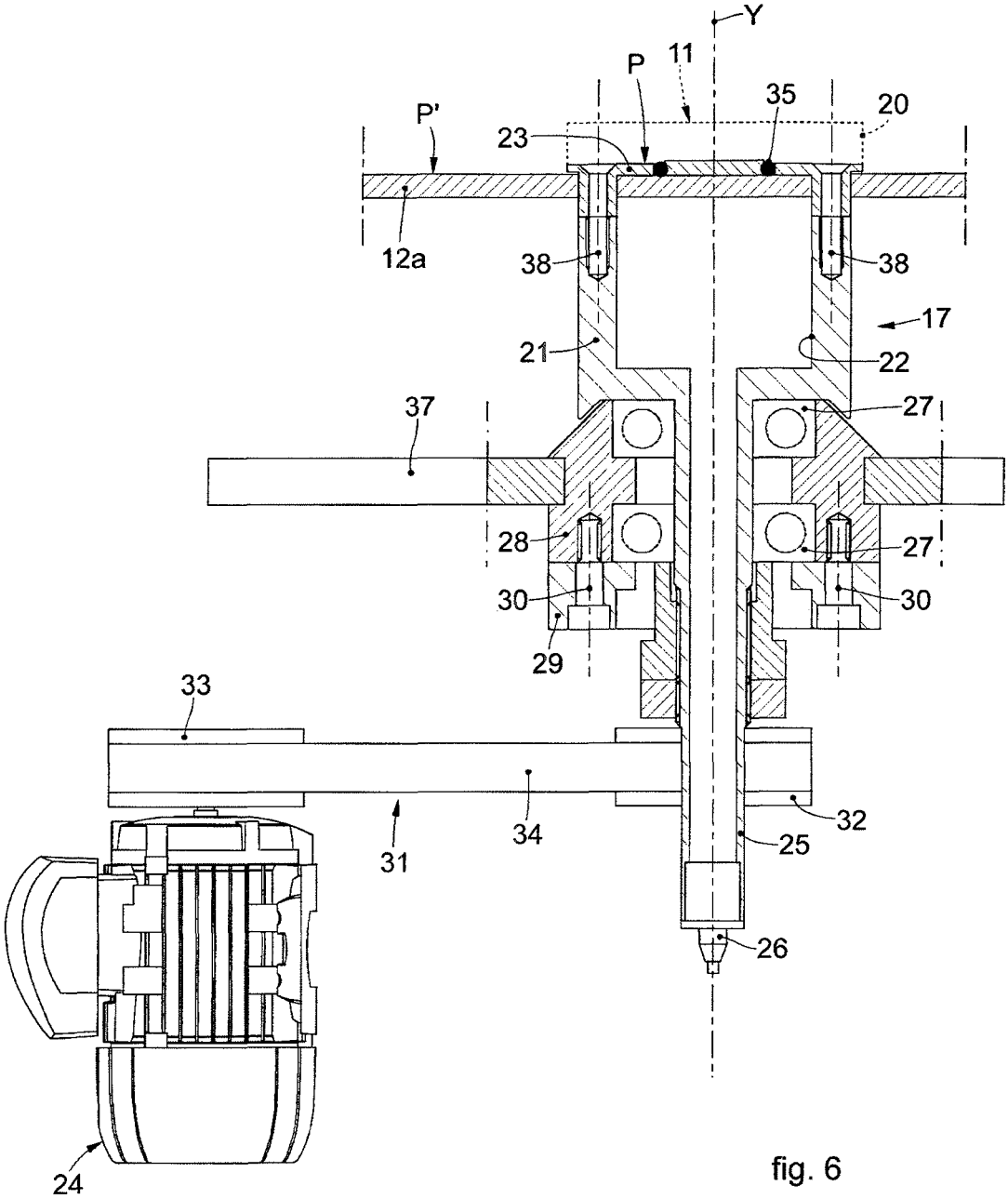
FIG. 6 is a longitudinal section view of an electromagnetic mandrel able to support and make the metal element rotate.

The electromagnetic mandrel 17, see FIG. 6, comprises a main body 21 to house at least one electromagnet 22 and a support 23 to hold the metal element 11 in position following the excitation of the electromagnet 22. The support 23 can be for example of circular shape.

The main body 21 is connected to drive means 24, for example an electric motor or suchlike, configured to make the support 23 of the electromagnetic mandrel 17 rotate on a work surface P on which the metal element 11 lies.

Substantially, the support 23 of the electromagnetic mandrel 17 is made to rotate with respect to an axis Y substantially orthogonal to the work surface P.

The work surface P is substantially coplanar with a surface P' on which the transfer tracks 12*a* and 12*b* lie.

The electromagnetic mandrel 17, see again FIG. 6, comprises a stem 25 connected on one end to the electromagnet 22 and on the other end to a rotary contact 26, which will be connected to another fixed contact and then to the electric power supply.

The stem 25 is provided with one or more rolling supports 27, for example a pair of ball bearings, disposed inside the main body 21.

The main body 21 can be positioned on a first block 28 connectable to a second block 29 by means of removable attachment elements 30, such as screws, bolts or other.

The stem 25 of the electromagnetic mandrel 17 is connected to the drive means 24 by means of a motion transmission unit 31, comprising for example pulleys 32 and 33 connected by means of a transmission belt 34, wherein a first pulley 32 is associated with the stem 25 and a second pulley 33 is associated with the drive means 24.

The electromagnetic mandrel 17 is supported by a fixed support plate 37, on which for example the first block 28 is positioned.

The support 23 of the electromagnetic mandrel 17 can also comprise a seating 35 suitable to support a protruding part 36 of the metal element 11 on which to apply the sealing material, for example a protruding annular part 36.

The support 23 of the metal element 11 is also interchangeable and removably connected to the main body 21 of the electromagnetic mandrel 17, for example by means of removable attachment elements 38 such as screws, bolts or other, so as to be interchangeable and support different types of metal element 11.

The sealing material delivery device 13, see for example FIG. 4 and FIG. 5, is positioned at least in correspondence with the periphery 20 of the metal element 11 and is able to deliver sealing material when the metal element 11 is held in position and made to rotate R, in one direction or the other, see also FIG. 2, by means of the electromagnetic mandrel 17.

The metal element 11 is maintained substantially level with the work surface P by the electromagnetic mandrel 17, thus avoiding translation, lowering or raising movements thereof with respect to the work surface P.

Figure 3:
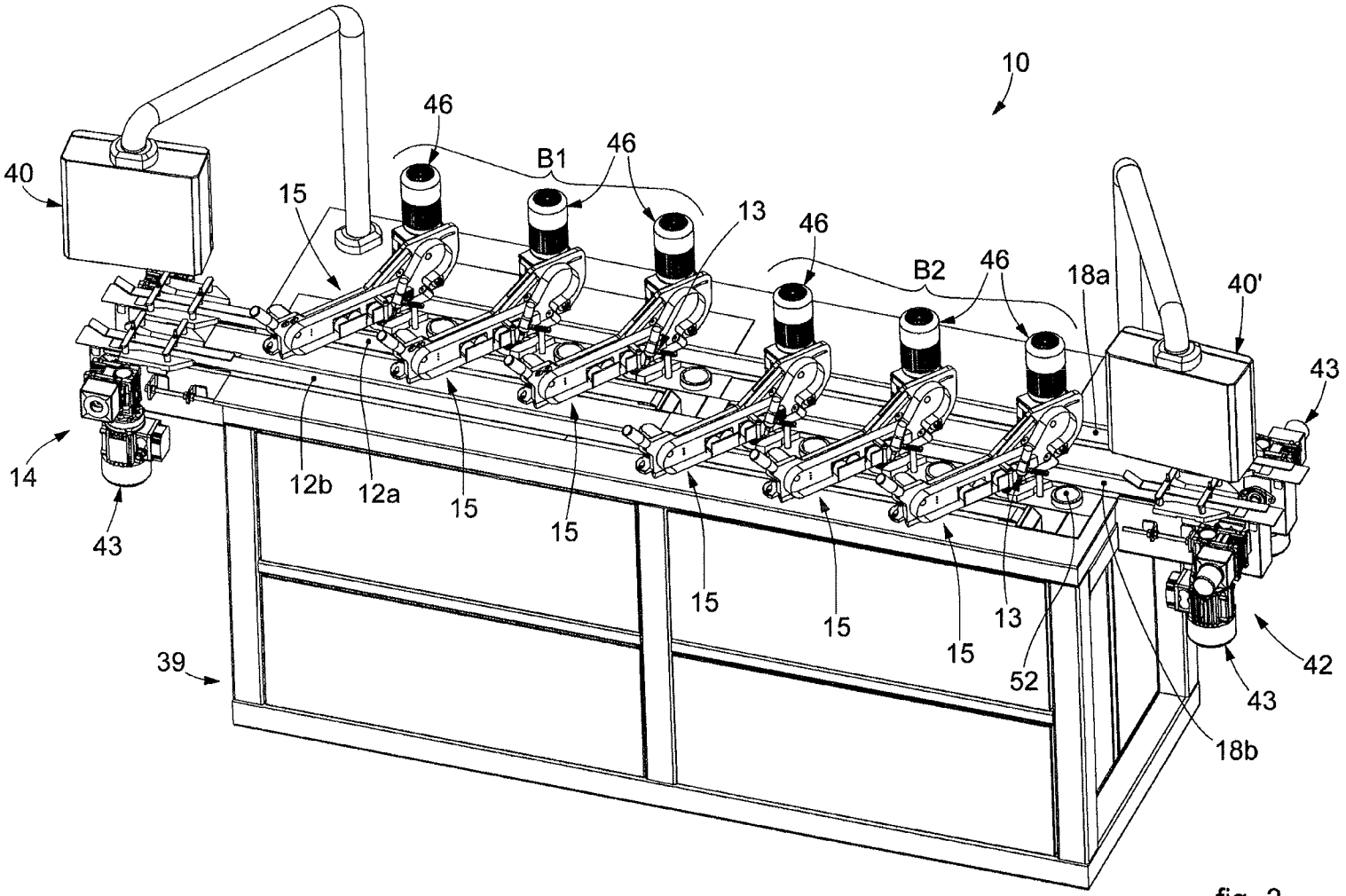
FIG. 3 is a three-dimensional view of the machine of FIG. 1.

The machine 10, generally comprises a base 39, see also FIG. 3, on which the one or more transfer tracks 12*a* and 12*b* and the one or more exit tracks 18*a*, 18*b* are disposed.

The machine 10 also comprises control units 40 and 40' able to control and regulate its various functioning modes to apply the sealing material on the metal elements 11.

Upstream of the base 39 of the machine 10 there is provided the entrance zone 14 of the metal elements 11 on which to apply the sealing material, while downstream of the base 39 of the machine 10 there is provided an exit zone 42 of the metal elements 11' provided with sealing material.

The transfer tracks 12*a*, 12*b* and/or the exit tracks 18*a*, 18*b* can comprise, or consist of, magnetic conveyor belts, able to hold the metal element in position and transfer it in the directions L of FIG. 1.

The transfer tracks 12*a*, 12*b* are located directly downstream of a supply apparatus 41 of the metal element 11 to which to apply the sealing material.

The supply apparatus 41 can be for example a press, a curling machine or suchlike and, as shown in FIG. 1, the metal elements 11 directly arrive at the machine 10 without the use of mechanical transfer means, stackers, devices to remove the metal elements or other.

The supply apparatus 41 will be provided with supply tracks 44 aligned with the transfer tracks 12*a*, 12*b* of the machine 10.

The transfer tracks 12*a*, 12*b* and the exit tracks 18*a*, 18*b* can be driven to move the metal elements 11 from said entrance zone 14 to said exit zone 42 by means of suitable drive means 43, for example electric motors or suchlike.

The transfer track 12*a* or 12*b* is directed in a first direction L1 or L2 different from a second direction L3 or L4 in which the second exit track 18*a* or 18*b* is directed, and the arm 15 is located in a third direction T which intersects the transfer tracks 12*a* or 12*b* and the exit tracks 18*a* or 18*b*.

In this case, the directions L1 of the transfer track 12*a* and the direction L4 of the exit track 18*b* are aligned, so as to confer high compactness to the machine 10.

In the present machine 10, see FIG. 3, a first battery B1 of arms 15 is provided which is associated with the first transfer track 12*a* and with the first exit track 18*a*. The arms 15 of the first battery B1 are reciprocally parallel and directed in directions parallel to the direction T.

The machine 10 also comprises a second battery B2 of arms 15 associated with the second transfer track 12*b* and with the second exit track 18*b*.

The arms 15 of the second battery B2 are also reciprocally parallel and preferably also directed in directions parallel to the direction T.

In particular, each of the two batteries B1 and B2 comprises three parallel arms 15, which are preferably all in operation. If, for any reason whatsoever, one of the arms 15 ceases to function, the other two arms 15 can absorb the workload of the machine, guaranteeing process continuity, therefore without interruptions.

As mentioned, each of the arms 15 comprises one or more electromagnets 16, 16', for example two electromagnets 16 and 16', see FIG. 4 and FIG. 5.

The arm 15 comprises a conveyor belt 45 cooperating with the electromagnets 16, 16' and driven in the direction T1 by means of suitable drive means 46, for example an electric motor or suchlike. By means of the conveyor belt 45 and the electromagnets 16, 16' the metal element 11 is substantially translated along the arm 15.

The arm 15 is also provided with at least one sensor 47, see FIG. 5, suitable to determine the arrival of a metal element 11 from the transfer track 12*a*, 12*b* and therefore command the suitable drive of the electromagnets 16, 16' and of the conveyor belt 45.

The arm 15 can assume an active or work position, as in FIG. 4, in which it is lowered onto the work surface P and therefore onto the transfer track 12*a*, 12*b*, and a raised inactive position, see FIG. 5.

The arm 15 can be provided, for example, with an electromagnetic unit 48 disposed at one end 49 of the arm 15 and which maintains the arm 15 in the work position of FIG. 4. In the normal functioning of the machine 10, the electromagnetic unit 48 is activated in order to maintain the arm 15 as in FIG. 4.

By deactivating the electromagnetic unit 48, provided for example with an electromagnet 51, the arm 15 moves automatically, by means of elastic means or other, to the position of FIG. 5, rotating around a pin 50.

As can also be seen from the comparison of FIG. 4 and FIG. 5, the sealing material delivery device 13 can also assume a first active position, FIG. 4, in which it is positioned substantially above the metal element 11, in particular in the zone onto which to apply the sealing material, and a second inactive position, FIG. 5, in which it is positioned above a bleeder receptacle 52.

The delivery device 13 is provided with at least one nozzle 53 to deliver the sealing material received, in a known manner, from a pipe 54 to supply the sealing material, removed for example from a receptacle outside the machine 10.

The nozzle 53, by means of the periodic bleeding in the receptacle 52, is always maintained efficient and clean.

In order to assume at least the active position, FIG. 4, and at least the inactive position, FIG. 5, the delivery device 13 is connected to a rotatable shaft 55 associated with suitable drive means, positionable in the base 39 of the machine 10.

As can also be seen from FIG. 5, guides 56 can be disposed at the sides of the support 23 of the electromagnetic mandrel 17, which are able to allow the correct centering of the metal element 11 on the support 23.

We will now describe an example of the functioning of the present machine 10.

The metal element 11 is supplied to the transfer tracks of the machine 10, for example the transfer track 12*a*, directly from the supply track 44 of the supply apparatus 41. The supply track 44 can comprise a conveyor belt, or suchlike.

The metal element 11 moves in the direction L1 thanks to the drive of the transfer track 12*a*, until it arrives in proximity to one of the arms 15 of the battery B1, let us say for example the arm 15 closest to the entrance zone 14 of the machine 10.

The sensor 47 of the arm 15 detects the presence of the metal element 11 on the transfer track 12*a*, then commands the drive of the first electromagnet 16, which lifts the metal element 11 from the transfer track 12*a* and puts it in contact with the lower surface of the conveyor belt 45 of the arm 15, see FIG. 4 and the metal element 11 shown in dashed lines.

The conveyor belt 45 that moves in the direction T1 and the activation of the first electromagnet 16 determine the displacement of the metal element 11 toward the electromagnetic mandrel 17, therefore in a zone above the support 23 of the electromagnetic mandrel 17.

Substantially, therefore, the metal element 11 which is initially located on a surface P' on which the transfer track 12*a* lies, passes to the work surface P defined by the support 23. The work surface P is advantageously substantially coplanar with the surface P'.

As can be seen from the drawings, the zones of the machine located on the sides of the transfer track 12*a* also lie on the surface P'.

When the metal element 11 arrives above the electromagnetic mandrel 17, the electromagnet 22 of the electromagnetic mandrel 17 is already excited and the support 23 of the electromagnetic mandrel 17 is already made to rotate with respect to the axis Y by means of the drive means 24. In this way, substantially, the metal element 11 is immediately attracted toward the support 23 of the electromagnetic mandrel 17, eliminating down times and slippage phenomena.

The metal element 11, which in FIG. 4 is shown again in a raised position and adhering to the conveyor belt 45, is released by deactivating the first electromagnet 16, and automatically attracted, in a precise manner and without slippages or delays, onto the support 23 of the electromagnetic mandrel 17.

If the metal element 11 comprises a protruding part 36, the latter is automatically disposed in the corresponding seating 35.

The delivery device 13, which is in the active position, can then deliver the sealing material onto the metal element 11 in rotation around the axis Y, applying for example a creasing 19 as in FIG. 2.

At the end of the sealing material application operation, the electromagnetic mandrel 17 is deactivated and the second electromagnet 16' of the arm 15 is activated, so that the metal element 11' provided with sealing material is raised and again located adhering on the lower surface of the conveyor belt 45, which will transfer the metal element 11' to the exit track 18*a*.

The metal element 11', by means of the drive of the exit track 18*a*, will be translated in direction L3 toward the exit zone 42 of the machine 10.

By providing two transfer tracks 12*a* and 12*b* and several batteries B1 and B2 of arms 15, as can be understood, it is possible to considerably increase the production of metal elements 11' provided with sealing material, coordinating the functioning of the various arms 15 of the two batteries B1 and B2.

For example, as seen above, if the arm 15 of a battery B1 or B2 is already engaged with a first metal element 11, it is possible to provide that a second metal element 11 coming from the same transfer track 12*a* or 12*b* passes to the subsequent arm 15 of the battery B1 or B2.

In the event two batteries B1 or B2 of arms 15 are used, moreover, it is possible to provide a control unit for each of the batteries, for example the control unit 40 to manage the battery B1 of arms 15 and the control unit 40' to manage the battery B2 of arms 15.

It is clear that modifications and/or additions of parts may be made to the machine for applying sealing material to a metal element, in particular intended for a metal package, as described heretofore, without departing from the field and scope of the present invention.

It is also clear that, although the present invention has been described with reference to some specific examples, a person of skill in the art shall certainly be able to achieve many other equivalent forms of machine for applying sealing material to a metal element, in particular intended for a metal package, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. Machine for applying sealing material to a metal element, intended for a metal package, comprising at least one transfer track to transport the metal element from an entrance zone to the machine to at least one sealing material application zone of the machine in which at least one delivery nozzle delivers the sealing material onto said metal element is positioned, wherein said machine further comprises at least one electromagnetic mandrel provided with a main body to house at least one electromagnet and a support to hold the metal element in position on a work surface following the excitation of said electromagnet, said main body being connected to a motor configured to make the support rotate on said work surface, said delivery nozzle of the sealing material being positioned at least in proximity to the periphery of the metal element and able to deliver sealing material when the metal element is held in position and made to rotate on said work surface by means of said support of the electromagnetic mandrel, wherein said machine further comprises at least one arm provided with the at least one electromagnet able to remove said metal element from said transfer track, to position it in correspondence with said electromagnetic mandrel in order to apply the sealing material by means of said delivery nozzle and then to transfer it from said electromagnetic mandrel to at least one exit track of the metal element on which the sealing material has been applied, wherein said arm comprises a conveyor belt cooperating with the at least one electromagnet and driven in a direction by a second motor, such that by means of the conveyor belt and the at least one electromagnet the metal element is translated along the arm, and wherein the arm is also provided with at least one sensor suitable to determine an arrival of a metal element from said transfer track and therefore command the second motor of the at least one electromagnet and of the conveyor belt.

2. Machine as in claim 1, wherein said work surface on which said metal element lies, during the application of the sealing material, is adjacent to a plane on which said at least one transfer track lies.

3. Machine as in claim 1, wherein said at least one transfer track is located, during use, directly downstream of a supply apparatus to supply the metal element to which the sealing material is applied.

4. Machine as in claim 1, wherein said transfer track is directed in a first direction different from a second direction along which said exit track is directed, and said at least one arm is located in a direction which intersects said transfer track and said exit track.

5. Machine as in claim 1, further comprising at least one battery of said at least one arm associated with at least one transfer track and the at least one exit track, said at least one arm of said battery being reciprocally parallel and directed in directions which intersect said at least one transfer track and said at least one exit track.

6. Machine as in claim 1, wherein said delivery nozzle of the sealing material is connected to a rotatable shaft provided with the motor, so that said delivery nozzle assumes at least a first active position in which it is positioned at least partly above said metal element, and a second inactive position in which it is positioned above a bleeder receptacle.

7. Machine as in claim 1, wherein said support of the metal element is interchangeable and connected to the main body of the electromagnetic mandrel by one or more fasteners.

8. Machine as in claim 1, wherein said support comprises at least one seating configured to house at least one protruding part of said metal element.

9. Machine as in claim 1, wherein said transfer track and/or said exit track comprises at least one magnetic conveyor belt.

10. Machine as in claim 2, wherein said at least one transfer track is located, during use, directly downstream of a supply apparatus to supply the metal element to which the sealing material is applied.

11. Machine as in claim 10, further comprising at least one arm provided with the at least one electromagnet able to remove said metal element from said transfer track, to position it in correspondence with said electromagnetic mandrel in order to apply the sealing material by means of said delivery nozzle and then to transfer it from said electromagnetic mandrel to at least one exit track of the metal element on which the sealing material has been applied.

12. Machine as in claim 11, wherein said transfer track is directed in a first direction different from a second direction along which said exit track is directed, and said at least one arm is located in a direction which intersects said transfer track and said exit track.

13. Machine as in claim 11, further comprising at least one battery of said at least one arm associated with at least one transfer track and at least one exit track, said at least one arm of said battery being reciprocally parallel and directed in directions which intersect said at least one transfer track and said at least one exit track.

14. Machine as in claim 12, wherein said delivery nozzle of the sealing material is connected to a rotatable shaft provided with the motor, so that said delivery nozzle assumes at least a first active position in which it is positioned and at least partly above said metal element, and a second inactive position in which it is positioned above a bleeder receptacle.

15. Machine as in claim 14, wherein said support of the metal element is interchangeable and connected to the main body of the electromagnetic mandrel one or more fasteners.

16. Machine as in claim 15, wherein said support comprises at least one seating configured to house at least one protruding part of said metal element.

17. Machine as in claim 16, wherein said transfer track and/or said exit track comprises at least one magnetic conveyor belt.

18. Machine as in claim 13, wherein said delivery nozzle of the sealing material is connected to a rotatable shaft provided with the motor, so that said delivery nozzle assumes at least a first active position in which it is positioned at least partly above said metal element, and a second inactive position in which it is positioned above a bleeder receptacle.

19. Machine as in claim 18, wherein said support of the metal element is interchangeable and connected to the main body of the electromagnetic mandrel by one or more fasteners.

20. Machine as in claim 19, wherein said one or more fasteners is a screw or a bolt.

* * * * *